United States Patent [19]

Courvoisier et al.

[11] Patent Number: 4,660,303

[45] Date of Patent: Apr. 28, 1987

[54] REAR-ACCESS SKI BOOT

[75] Inventors: Guy Courvoisier; Simon Arieh, both of Geneva, Switzerland

[73] Assignee: Lange International S.A., Fribourg, Switzerland

[21] Appl. No.: 835,049

[22] Filed: Feb. 28, 1986

[30] Foreign Application Priority Data

Mar. 7, 1985 [CH] Switzerland ..... 1036/85

[51] Int. Cl.[4] ..... A43B 5/04

[52] U.S. Cl. ..... 36/119; 36/50

[58] Field of Search ..... 36/117–121, 36/50, 105; 24/115 H, 136 K, 136 L

[56] References Cited

U.S. PATENT DOCUMENTS

| | | | |
|---|---|---|---|
| 4,160,332 | 7/1979 | Salomon . | |
| 4,192,087 | 3/1980 | Salomon . | |
| 4,205,467 | 6/1980 | Salomon . | |
| 4,574,500 | 3/1986 | Aldinio et al. | 36/119 |

FOREIGN PATENT DOCUMENTS

| | | | |
|---|---|---|---|
| 0132744 | 2/1985 | European Pat. Off. | 36/117 |
| 0146502 | 6/1985 | European Pat. Off. | 36/119 |
| 0157118 | 10/1985 | European Pat. Off. | 36/117 |
| 0165525 | 12/1985 | European Pat. Off. | 36/117 |
| 0169190 | 1/1986 | European Pat. Off. | 36/117 |
| 2341658 | 3/1974 | Fed. Rep. of Germany | 36/117 |
| 8301150 | 10/1984 | Netherlands | 36/50 |

*Primary Examiner*—James Kee Chi

*Attorney, Agent, or Firm*—Brumbaugh, Graves, Donohue & Raymond

[57] ABSTRACT

This ski boot comprises an inner skipper fitted in a rigid outer shell and the skier's heel is caused to fit in the rear portion of the boot by a pressure plate disposed between the shell and the slipper, on the instep. The pressure exerted by this plate is obtained by means of a cable acting in the fashion of a garrot when a rotary control member is actuated so as to twist the cable having its ends attached to the shell in the heel portion thereof.

3 Claims, 4 Drawing Figures

REAR-ACCESS SKI BOOT

BACKGROUND OF THE INVENTION

The present invention relates to ski boots in general and has specific reference to a ski boot having a rigid shell rigidly coupled to the sole and adapted to surround the foot, the heel and the instep or lower front portion of the ankle, and an upper consisting of the one hand of a front quarter of substantially gutter configuration opening to the rear and rigidly coupled to the shell, and on the other hand of a rear quarter also of gutter configuration, pivotally connected to the shell or to said front quarter of the upper so as to fit in said front quarter while surrounding the ankle, means for holding the two interfitting quarters in their assembled condition, an inner shoe or slipper, a pressure member on the vamp of said inner shoe which fits around the instep, and means for exerting a pressure against said pressure member towards the heel.

THE PRIOR ART

It is known that the skis cannot be properly controlled unless the heel fits exactly and is firmly held in its cavity at the heel end of the ski boot. In ski boots open at the top a buckle located at the instep level and interconnecting the two overlapping edges of the upper or cuff permits, by pulling the tongue, of forcing the foot backwards and thus keep the heel in the desired position. In rear access ski boots, of which the instep-engaging front quarter consists of a one-piece member, auxiliary means have already been provided for urging the foot backwards. It is known to use for this purpose a pressure plate disposed within the boot shell, on the instep portion of the inner slipper, and to provide a pressure screw on the shell for exerting a pressure against said pressure plate, the latter having the function of distributing this pressure on the slipper and foot surface. It is also known to assemble the two edges of the cuff and slipper which engage the pressure plate by means of a transverse screw having left-handed threads on one side and right-handed threads on the opposite side, whereby the two edges of the cuff can be brought together for causing a pressure to be exerted on the pressure distribution plate.

SUMMARY OF THE INVENTION

It is the object of the present invention to provide in a ski boot of the above-defined type a particularly simple, light and small-sized device for exerting a pressure on the pressure distribution plate.

The ski boot according to the present invention is characterized by the fact that the means for exerting a pressure on the pressure plate comprise on the one hand a cable extending between the shell and the slipper, and having one end attached to the shell in the heel area thereof so as to extend with its two sides around said slipper and said pressure plate, and on the other hand a rotary tension member reacting against the outer surface of the shell in front of said pressure plate, said cable being secured to said rotary tension member so as to rotate therewith, whereby the rotation of said tension member is attended by the twisting of the two cable sides between said shell and said pressure plate, so as to exert the desired pressure against said plate.

The pressure means according to the present invention is particularly simple since it is only necessary to form a loop with the cable and to connect the cable by means of a pin to a rotary control knob reacting against the shell. By twisting the cable the effort exerted on the knob is multiplied to a substantial degree, so that the foot can be tightened quite easily in the ski boot. Furthermore, the pressure is not exerted on a single point of the distribution plate, and therefore a semi-rigid plate can be used instead of a rigid plate.

THE DRAWINGS

DESCRIPTION OF THE PREFERRED EMBODIMENT

Figure 1:
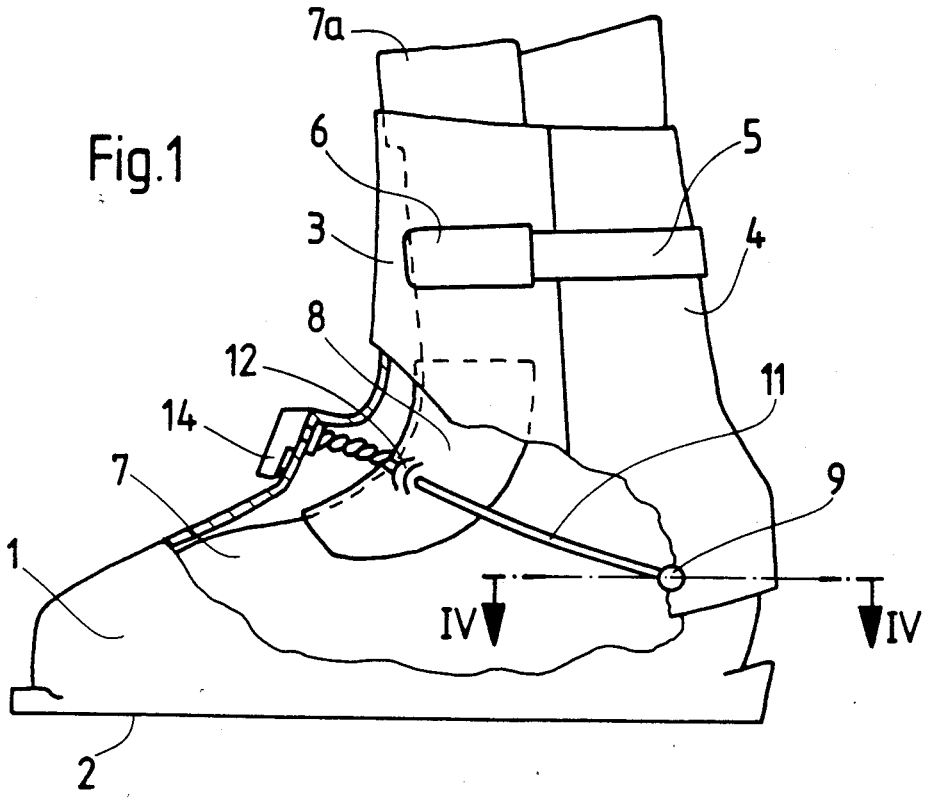
FIG. 1 is a side elevational view of a rear access ski boot with the shell partly broken away, the upper and the closing means being shown only diagrammatically.

The ski boot illustrated in FIG. 1 comprises, in a manner well known per se, a rigid shell 1 comprising the sole 2 and surrounding the skier's foot, heel and the front portion of the ankle. Mounted to this shell 1 is an upper in the form of a cuff comprising two quarters, notably a gutter-shaped front quarter 3 opening to the rear and pivotally connected on both sides to the shell at two pivot points (not shown) substantially at the level of the malleolus or foxing.

The inclination of this front quarter 3 with respect to the sole 2 is adjustable by known means (not shown). The cuff also comprises a rear quarter 4 also of gutter configuration which opens forwards and is dimensioned to fit inside the side edges of the front quarter 3. The rear quarter 4 is also pivotally mounted to the shell 1, adjacent the heel, at two opposite pivot points lying on a horizontal transverse axis, so that the rear quarter 4 can be tilted back for putting on the ski boot. This rear quarter 4 may also, if desired, consist of a flap pivotally connected to the front quarter 3 about a substantially vertical axis. Adequate means such as a strap 5 surrounding the rear quarter 4, and a tension buckle 6 carried by the front quarter 3, are provided for tightening the cuff on the skier's ankle. Inside the shell 1 and the cuff 3,4 a soft, flexible slipper 7 is fitted. This slipper 7 comprises an upper consisting of two quarters *7a, 7b* to permit the insertion of the foot into the slipper.

Figure 3:
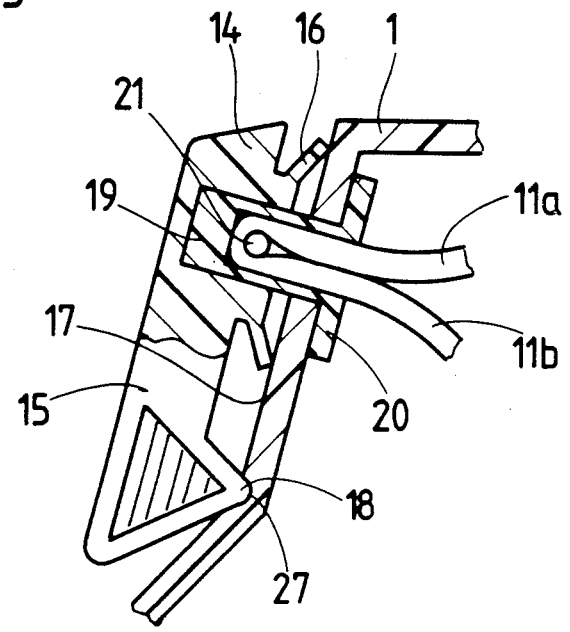
FIG. 3 is a fragmentary sectional view of the means for controlling the tightening means, the section being taken along a plane parallel to the drawing.

Fitted on the slipper portion corresponding to the instep and inside the shell 3 is a plate 8 of semi-rigid synthetic material. This plate 8 has substantially a horse-saddle configuration matching with the instep profile. At two opposite points 9 and 10 of the shell 1, substantially in the heel area, the ends of a cable 11 of synthetic material (for instance Nylon, a Registered Trademark) are secured to the shell. This cable 11 extends through a pair of lateral loops 12,13 formed in plate 8, and is attached intermediate its ends to a rotary control knob 14 so as to rotate therewith when the knob is actuated. This control knob 14 is shown in detail in FIG. 3. It conprises an arm 15 acting as a thumb lever to facilitate its actuation by the skier and bears through a tapered resilient lip 16 against a flat face 17 of shell 1. At least one hollow 27 is formed in this flat face 17 to constitute detent-positioning means for engagement by the bent end portion 18 of arm 15. In a blind bore of knob 14 a socket 19 formed with an integral flange 20 is fitted. This flange 20 is adapted to react against the inner surface of shell 1 and the loop-forming cable 11 is retained in this socket 19 by a cross pin 21 for simultaneously interlocking the knob 14 and socket 19. The socket 19 and knob 14 may be made from any suitable resin or metal.

Figure 4:
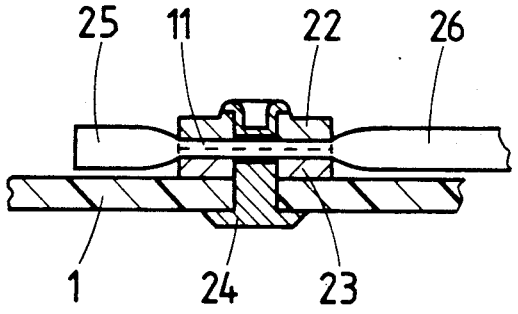
FIG. 4 is a fragmentary and sectional view showing the means for fixing one of the cable ends, the section being taken along the line IV—IV of FIG. 1.

FIG. 4 illustrates in section taken along the line IV—IV of FIG. 1 the manner in which the cable ends are attached to the shell 1 at positions 9 and 10. The cable end 11 is clamped between two metal washers 22,23 and passed through the diametral hole of a rivet 24 extending through the shell 1 for retaining and clamping the washers 22 and 23. Furthermore, the cable end is retained by flattening the cable portions extending on either side of washers 22 and 23, as illustrated at 25 and 26.

Figure 2:
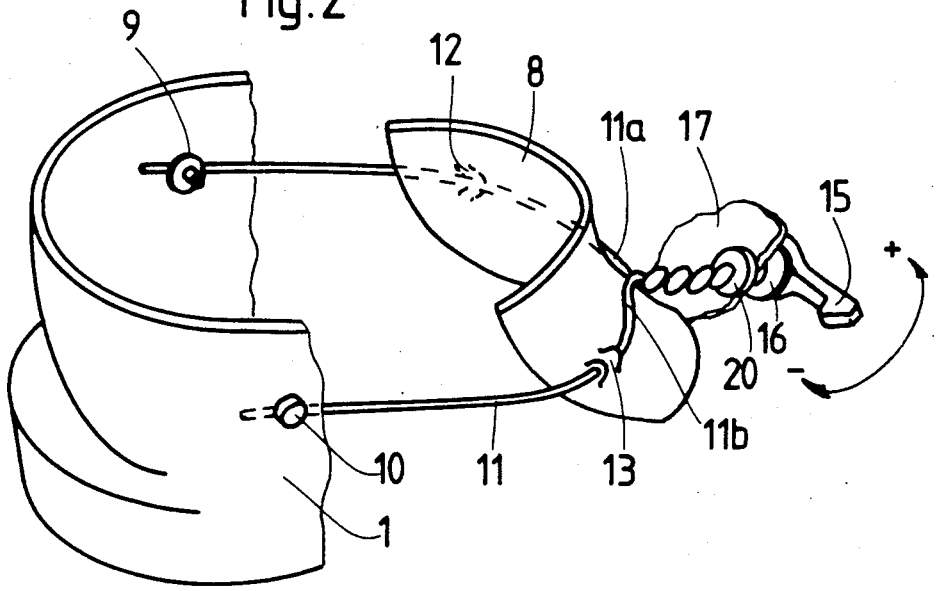
FIG. 2 is a perspective view showing the pressure plate and the tightening means.

When the knob 14 is rotated, the cable loop 11 formed in this knob is also rotated and consequently the two cable sides 11*a* and 11*b* are twisted as shown in FIG. 2. This twisting action acts as a garrot, and the resulting pressure exerted by the cable 11 on the underlying slipper surface is distributed by the pressure plate 8. The necessary effort to be exerted through the thumb arm 15 of knob 14 is relatively moderate, since it is multiplied by the twisting action.

It will be readily understood by those conversant with the art that the term "cable" as used herein refers to any cable or small cord of synthetic or natural material, or any metal or alloy suitable for the purpose.

Of course, this cable could be attached to the shell through any other suitable means, at its ends in the heel area and to the knob 14. This cable could form for instance a loop around the heel and have its sides attached to the rotary knob 14, for example in the manner shown in FIG. 4.

What is claimed is:

1. A rear-access ski-boot comprising a rigid shell rigidly coupled to the sole and adapted to surround the foot, the heel and the instep or lower front portion of the ankle, and an upper consisting on the one hand of a front quarter of substantially gutter configuration opening to the rear and rigidly coupled to the shell, and on the other hand of a rear quarter also of gutter configuration, pivotally connected to the shell or to said front quarter of the upper so as to fit in said front quarter while surrounding the ankle, means for holding the two interfitting quarters in their assembled condition, an inner shoe or slipper, a pressure member on the vamp of said inner slipper which corresponds to the instep, and means for exerting a pressure against said pressure member towards the heel, wherein said means for exerting a pressure against said pressure member consist on the one hand of a cable disposed between said shell and said slipper and attached to said shell in the heel area so as to surround said slipper and said pressure member with its two sides, and on the other hand of a rotary tension member reacting against the inner surface of said shell, in front of said pressure member, said cable being attached to said rotary tension member so as to rotate bodily therewith, whereby the rotation of said tension member is attended by the twisting of the two cable sides between said shell and said pressure member, this twisting causing a pressure to be exerted against said pressure member.

2. The ski boot of claim 1, wherein said cable forms a loop in said rotary tension member and has its ends attached to said shell on either side of the heel.

3. The ski boot of claim 1, wherein said cable forms a loop around the heel and has its ends attached to said rotary tension member.

* * * * *